United States Patent [19]

Hendershot

[11] Patent Number: 4,725,846

[45] Date of Patent: Feb. 16, 1988

[54] DISGUISE ANTENNA OPERATING IN THE CELLULAR BAND

[75] Inventor: James R. Hendershot, Arroyo Grande, Calif.

[73] Assignee: Western Mobile Communications, Inc., Arroyo Grande, Calif.

[21] Appl. No.: 940,931

[22] Filed: Dec. 12, 1986

[51] Int. Cl.[4] ..... H01Q 1/100

[52] U.S. Cl. ..... 343/792; 343/715; 343/791; 343/900

[58] Field of Search ..... 343/711, 713–715, 343/790–792, 888, 889, 725, 729, 751, 900, 901

[56] References Cited

U.S. PATENT DOCUMENTS

| | | | |
|---|---|---|---|
| 3,899,787 | 8/1975 | Czerwinski | 343/872 |
| 4,095,229 | 6/1978 | Elliot | 343/715 |
| 4,675,687 | 6/1987 | Elliot | 343/715 |

FOREIGN PATENT DOCUMENTS

| | | |
|---|---|---|
| 86/06216 | 10/1986 | PCT Int'l Appl. . |
| 87/00351 | 1/1987 | PCT Int'l Appl. . |

*Primary Examiner*—William L. Sikes
*Assistant Examiner*—Doris J. Johnson
*Attorney, Agent, or Firm*—Daniel C. McKown

[57] ABSTRACT

The present invention is a high frequency antenna for use in vehicular radio communications which is disguised to resemble a low frequency antenna of the type ordinarily used on vehicles to receive the standard AM-FM broadcast bands. In the preferred embodiment, the antenna consists of three tubular conductive sections that are held in spaced relationship to one another by the use of insulators, which insulate the sections from each other.

1 Claim, 3 Drawing Figures

DISGUISE ANTENNA OPERATING IN THE CELLULAR BAND

BACKGROUND OF THE INVENTION

The present invention is in the field of antennas, and particularly relates to an antenna for use at, typically, 800 MHz in cellular telephone systems, and that is disguised as an AM-FM antenna of the type commonly used on automobiles and other vehicles.

Alternatively, the present invention can be viewed as a combination of high and low frequency antennas made in such a way that the combined antenna externally resembles a common type of antenna used at the lower frequencies.

The introduction of cellular telephone systems for use in vehicles was accompanied by numerous incidents of theft in which telephone instruments and related electronic equipment were stolen from the vehicles. Clearly, the peculiar corkscrew-shaped antenna used for the cellular telephone was being used by the thieves to determine which vehicles to attack. In some cities, the theft problem is still so severe that insurance coverage against theft damage to the vehicle is difficult to obtain.

The present invention solves this problem by providing an antenna that is effective for use with a vehiclemounted cellular telephone, but which resembles the AM-FM broadcast band antenna commonly used on vehicles. When the antenna of the present invention is installed on a vehicle, a thief cannot tell by looking at the antenna whether the vehicle is carrying cellular telephone equipment.

Another application of the present invention is in the law-enforcement field. Vehicles used in this field frequently are equipped with cellular telephone equipment. However, the use of the corkscrew antenna attracts attention to the vehicle and tends to identify it as a law-enforcement vehicle. For some types of law-enforcement work this is a considerable disadvantage.

Thus, there is a well-documented need for an antenna suitable for use with cellular telephone equipment, but which looks like the more conventional type of vehicle antenna.

SUMMARY OF THE INVENTION

One object of the present invention is to provide apparatus that resembles a conventional vehicular AM-FM antenna, but which is effective as a cellular telephone antenna for operation at frequencies in the range of 800 MHz.

Another objective of the present invention is to provide apparatus which serves as an antenna for a cellular telephone operating at 800 MHz and that simultaneously serves as a conventional vehicular AM-FM antenna, and which resembles in its physical appearance the conventional antenna.

In accordance with the present invention, these objectives are achieved by using a $\frac{5}{8}\lambda$ over $\frac{1}{2}\lambda$ coaxial dipole antenna configuration for the cellular telephone antenna. This high frequency antenna is insulated from and mounted on a section of tubing that in turn is mounted by means of an insulator to the body of the vehicle. In this way, the apparatus includes three tubular sections which simulate the appearance of the sections of a conventional antenna. These sections are: the lower tubular section which elevates the cellular telephone antenna and which is used in the preferred embodiment as an antenna for the AM-FM broadcast bands; the middle tubular section which is the ground sleeve of the coaxial dipole cellular telephone antenna; and the top section which is the radiator of the coaxial dipole antenna. The three sections of the antenna are insulated electrically from each other; but mechanically, the insulators serve to retain the sections in a proper relation with each other.

In an alternative embodiment in which the antenna telescopes, the insulators serve to guide the sliding of the sections with respect to one another.

In accordance with the present invention, the insulators include axial passages through which the electrical feed to the high frequency antenna passes.

These features will be better understood in connection with the description given below and the accompanying drawings. However, the drawings are for the purpose of example only and are not intended to define the limits of the invention.

DETAILED DESCRIPTION OF THE PREFERRED EMBODIMENT

Figure 1:
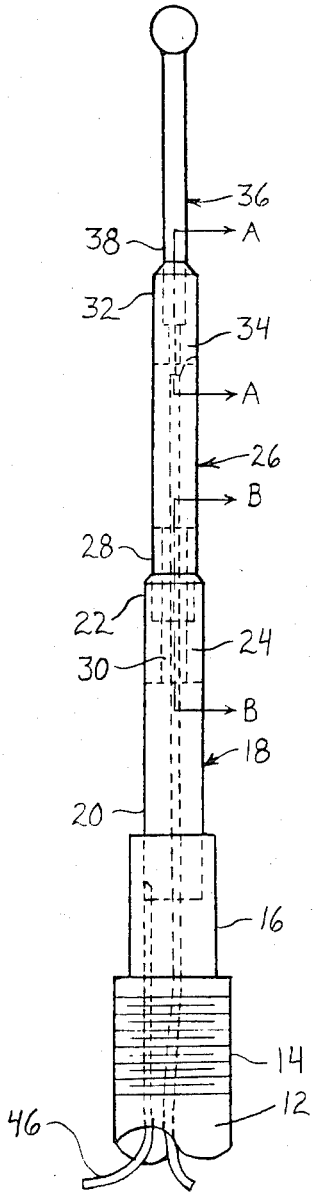
FIG. 1 is a side elevation view of a preferred embodiment of the disguise antenna of the present invention.

The disguise antenna of the preferred embodiment is mounted to a vehicle by inserting the metal mounting stud 12 through a hole in the metal body of the vehicle and locking the stud in position by the use of opposing nuts (not shown) that engage the threads 14. The metal mounting stud 12 is hollow and the insulative base 16 extends from it. The purpose of the insulative base 16 is to insulate the antenna from the metal body of the vehicle.

A first conductive tubular section 18 extends along the axis of the antenna from the insulative base 16. The first conductive tubular section 18 includes a proximal end portion 20 and a distal end portion 22. The length of the first conductive tubular section 18 is not critical, and in the preferred embodiment, its length is less than 20 inches.

Figure 3:
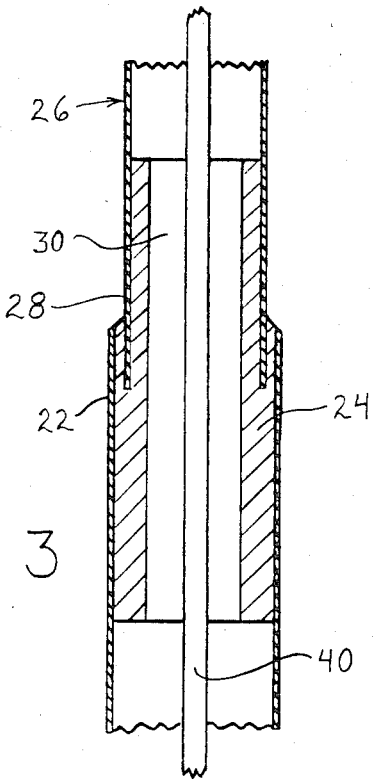
FIG. 3 is a fractional cross-sectional side view taken in the direction of B—B indicated in FIG. 1.

A first insulator 24 is lodged in the distal end portion 22 of the first productive tubular section 18. The first insulator 24 serves to insulate the first conductive tubular section 18 from the second conductive tubular section 26. The first insulator 24 includes an axial passage 30, best seen in FIG. 3.

The second conductive tubular section 26 includes a proximal end portion 28 and a distal end portion 32. The second conductive tubular section 26 extends beyond the distal end of the first conductive tubular section 18 a distance equal to $\frac{1}{2}\lambda$, where $\lambda$ is the wavelength used by the cellular telephone.

Figure 2:
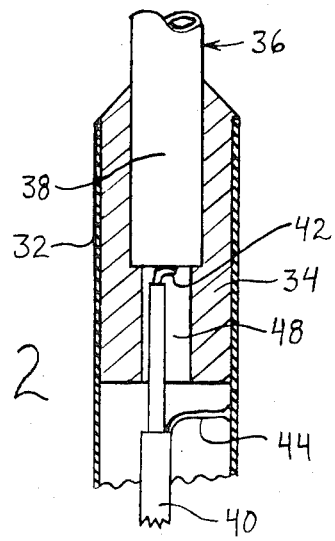
FIG. 2 is a fractional cross-sectional side view taken in the direction of A—A indicated in FIG. 1.

A second insulator 34 is lodged in the distal end portion 32 of the second conductive tubular section 26. A conductive radiator 36 extends axially approximately $\frac{5}{8}\lambda$ beyond the distal end of the second conductive tubular section 26. As best seen in FIG. 2, the proximal end portion 38 of the conductive radiator 36 engages the second insulator 34. The second conductive tubular section 26 serves as a ground sleeve for the radiator 36.

A coaxial cable 40 extends within the antenna and terminates at the proximal end portion 38 of the conductive radiator 36. The second insulator includes an axial passage 48 which extends through it and permits the shielded center conductor 42 of the cable to be soldered or welded to the proximal end of the conductive radiator 36. The shield of the coaxial cable is soldered or welded to the distal end portion 32 of the second conductive tubular section 26. An AM-FM radio antenna lead 46 is welded or soldered to the first conductive tubular section 18 in an optional aspect of the invention to permit the first conductive tubular section 18 to serve as an antenna for use with the AM or FM broadcast bands. The radiator 36 in association with the second conductive tubular section 26 constitutes a coaxial antenna for use at higher frequencies, such as 800 MHz.

The overall length of the antenna and its appearance suggests that it is an ordinary broadcast band antenna, notwithstanding the fact that it incorporates the higher-frequency antenna formed by the radiator 36 and the second conductive tubular section 26.

Thus, there has been described a preferred embodiment of the disguise antenna of the present invention, and other embodiments of it are possible. For example, the antenna could be designed to permit it to telescope. This and other variations of the invention are deemed to be apparent to workers in the art. All such variations are considered to be within the scope and spirit of the present invention.

What is claimed is:

1. Apparatus appearing to be a lower-frequency antenna and incorporating a higher-frequency antenna for use at a wavelength $\lambda$, said apparatus comprising:

an insulative base;

a first conductive tubular section extending along an axis from said insulative base, having a proximal end portion attached to said insulative base, and having a distal end portion;

a first insulator engaging the distal end portion of said first conductive tubular section, said first insulator including a passage extending axially through it;

a second conductive tubular section extending axially approximately $\frac{1}{2}\lambda$ beyond the distal end portion of said first conductive tubular section but electrically insulated from it by said first insulator, having a proximal end portion engaging said first insulator, and having a distal end portion;

a second insulator engaging the distal end portion of said second conductive tubular section, said second insulator including a passage extending axially through it;

a conductive radiator section extending axially approximately $\frac{5}{8}\lambda$ beyond the distal end portion of said second conductive tubular section but electrically insulated from it by said second insulator, and having a proximal end portion engaging said second insulator; and, a feed line having a first conductor electrically connected to the proximal end portion of said conductive radiator and having a second conductor electrically connected to the distal end portion of said second conductive tubular section, said feed line extending axially through said second conductive tubular section, through the passage in said first insulator, and through said first conductive tubular section.

* * * * *